United States Patent [19]

Fratzke

[11] Patent Number: 4,708,577

[45] Date of Patent: Nov. 24, 1987

[54] SELF-LEVELING FORK LIFT APPARATUS

[76] Inventor: Mark E. Fratzke, Rte. 3, 25 North View Ct., Hutchinson, Minn. 55350

[21] Appl. No.: 847,512

[22] Filed: Apr. 3, 1986

[51] Int. Cl.[4] ..... B66F 9/22

[52] U.S. Cl. ..... 414/635; 414/637; 414/673; 414/634; 187/9 E; 180/41

[58] Field of Search ..... 414/628, 629, 630, 631, 414/632, 634, 635, 636, 637, 638, 673, 542, 544; 187/9 R, 9 E; 180/41

[56] References Cited

U.S. PATENT DOCUMENTS

| | | | |
|---|---|---|---|
| 2,059,150 | 10/1936 | Schroeder | 187/9 R |
| 2,126,289 | 8/1938 | Schroeder | 414/632 |
| 2,707,063 | 4/1955 | Gran et al. . | |
| 3,086,670 | 4/1963 | Cuendet . | |
| 3,482,722 | 12/1969 | Simovich . | |
| 3,515,301 | 6/1970 | Emke | 414/634 |
| 3,893,580 | 7/1975 | Stevens . | |

FOREIGN PATENT DOCUMENTS

| | | | |
|---|---|---|---|
| 1017535 | 10/1957 | Fed. Rep. of Germany | 414/632 |
| 1510019 | 12/1967 | France | 187/9 |
| 1470499 | 4/1977 | United Kingdom | 414/673 |

OTHER PUBLICATIONS

Allis-Chalmers Lift Trucks, Industrial Truck Buyer's Guide, Doc. MH-1102A (4-1985).

*Primary Examiner*—Frank E. Werner
*Attorney, Agent, or Firm*—Kinney & Lange

[57] ABSTRACT

A fork lift truck includes a mast support bar to which the mast supporting carriage and fork lift tines are mounted. The mast support bar includes a central arc-shape segment on which a concentric arc-shape mast support sleeve is slidably mounted. The mast is mounted to the sleeve and power means are provided to slide the sleeve in either direction on the mast support bar. When the fork lift truck encounters uneven ground so that the wheels on one side of the truck are higher than the wheels on the other, the operator will slide the mast support sleeve with respect to the mast support bar to keep the mast in a vertical position over the truck.

9 Claims, 5 Drawing Figures

SELF-LEVELING FORK LIFT APPARATUS

BACKGROUND OF THE INVENTION

1. Field of the Invention

This invention has relation to a fork lift truck and more particularly to an apparatus whereby the pay load being picked up, carried and delivered by a fork lift truck, and the mast and carriage supporting the pay load, can be maintained in a substantially upright condition when the truck encounters uneven ground.

2. Description of the Prior Art

Fork lift trucks are well known in industrial, commercial and agricultural environments for use in picking up a pay load (whether or not on a pallet), moving it to a needed location, and depositing it at that location to a desired position. Typically such equipment consists of a wheel supported truck body, a pair of primary load support wheels at a front end portion of that body, an elongate mast supported by the truck body near the support wheels, and a carriage including, typically, a pair of parallel, spaced-apart fork lift tines, the carriage being power operated to move up and down the mast as needed.

Where such trucks are used in a closed industrial location having a substantially flat horizontal floor throughout, the problem of picking, transporting and delivering the pay load is relatively simple. However, it is known in the prior art to provide a straight horizontal mast support bar extending across a front end portion of the truck body and to mount the mast on a sleeve which is supported by the horizontal mast support bar and is movable along it in a horizontal direction. Hydraulic means has been provided to move the sleeve along the bar so that when the truck lift operator brings a pay load into a position where it is to be unloaded, but finds that the pay load, carriage and mast are a few inches out of alignment with the desired final positioning of the pay load, the mast, carriage and pay load can be shifted several inches one way or the other along the mast support bar, until the proper alignment is achieved and deposit or delivery of the pay load can be made.

When working outside over rough terrain, another problem presents itself. The unevenness of the terrain can cause a pay load resting on the forks of a fork lift carriage to assume a position other than horizontal so that it is difficult or impossible to move the pay load into a desired bin opening, for example, without leveling the pay load.

Also, when the fork lift truck must move over uneven ground, there is the problem of keeping the pay load and the fork lift portion of the carriage sufficiently level so that the pay load will not fall from the mast. One solution offered for this problem has been to make the carriage which moves up and down on the mast in two distinct units, one part being movable up and down the mast at whatever angle the mast assumes when the truck is traveling over uneven ground, and a second part of the carriage, including the fork lift tines, being rotatable with respect to the first part of the carriage so that the pay load and the tines can be maintained in a substantially horizontal orientation.

A drawing of a prior art structure commonly used to provide horizontal alignment for a pay load package on a carriage even though the fork lift truck is not on horizontal ground is illustrated in FIG. 5 as part of the prior art. In this figure, a wheel supported fork lift truck 110 is supported on primary load support wheels 114,114 and includes a perfectly straight elongate mast support bar 115 on which a mast 130 is supported. As the fork lift truck moves onto non-horizontal ground such as illustrated at 148, the mast 130 maintains its position normal to the surface on which the support wheels 114,114 rest and takes up the position as seen in FIG. 5. In order to be able to unload a pay load package 150 onto a horizontal surface, this prior art structure provides that a first part of a carriage (not shown) moves in parallel relation to the tilting fork lift mast 130 while the second forward part of the carriage, including fork lift tines 146,146 is rotated with respect to the first part of the carriage to position as seen in FIG. 5.

As clearly seen in that figure, this puts the center of gravity of the pay load package far from the center of gravity of the truck itself, and can move the center of gravity of the load very easily outside of the outer edges of the primary load support wheels 114,114. This can easily lead to a tip over of the lift truck and consequently a dumping of the load. Some idea of the dangers involved in this prior art structure can be gleaned from the ratings of Allis-Chalmers Lift Trucks in their Industrial Truck Buyer's Guide, Document MH-1102A dated April 1985 in which their Model ACP 100C has a weight of only 14,500 pounds and an overall width of 54.6" and is rated to be able to lift 10,000 pounds.

A structure which makes it possible to operate a lift truck on non-horizontal ground and still maintain the center of gravity well within the outside of the support wheels, was clearly needed before the present invention.

Neither the inventor nor those in privity with him are presently aware of any prior art which is closer than that discussed above and are not aware of any prior art which renders unpatentable any of the claims made herein.

SUMMARY OF THE INVENTION

This invention presents a self-leveling fork lift apparatus for use with a lift truck which includes a wheel supported frame, a pair of primary load support wheels supported at a first front and portion of the truck frame to rotate on a common axis, and means to steer and propel the lift truck.

The apparatus of the invention includes an elongate mast support bar having a central arc-shape guide portion, a means to support opposite ends of this mast support bar at a forward portion of the truck frame to lie in a substantially vertical first plane parallel to the support wheels rotation axis, and a mast support sleeve supported on the central portion of the mast support bar to be movable along the arc-shape guide portion of that bar.

The fork lift mast is supported on the support sleeve and extends upwardly from it, and a power operated fork lift carriage is supported on the mast to move longitudinally, up and down, with respect to the mast.

The mast support sleeve is movable between a first position where the mast is tilted toward a first side of a second plane which is perpendicular to the support wheels rotation axis and which lies midway between the support wheels, and a second position whereby the mast is tilted toward a second side of that second plane. Power means is provided to move the mast support sleeve along the arc-shape guide portion of the elongate mast support bar between these first and second positions of the sleeve with respect to the bar.

DETAILED DESCRIPTION OF THE PREFERRED EMBODIMENT

Figure 1:
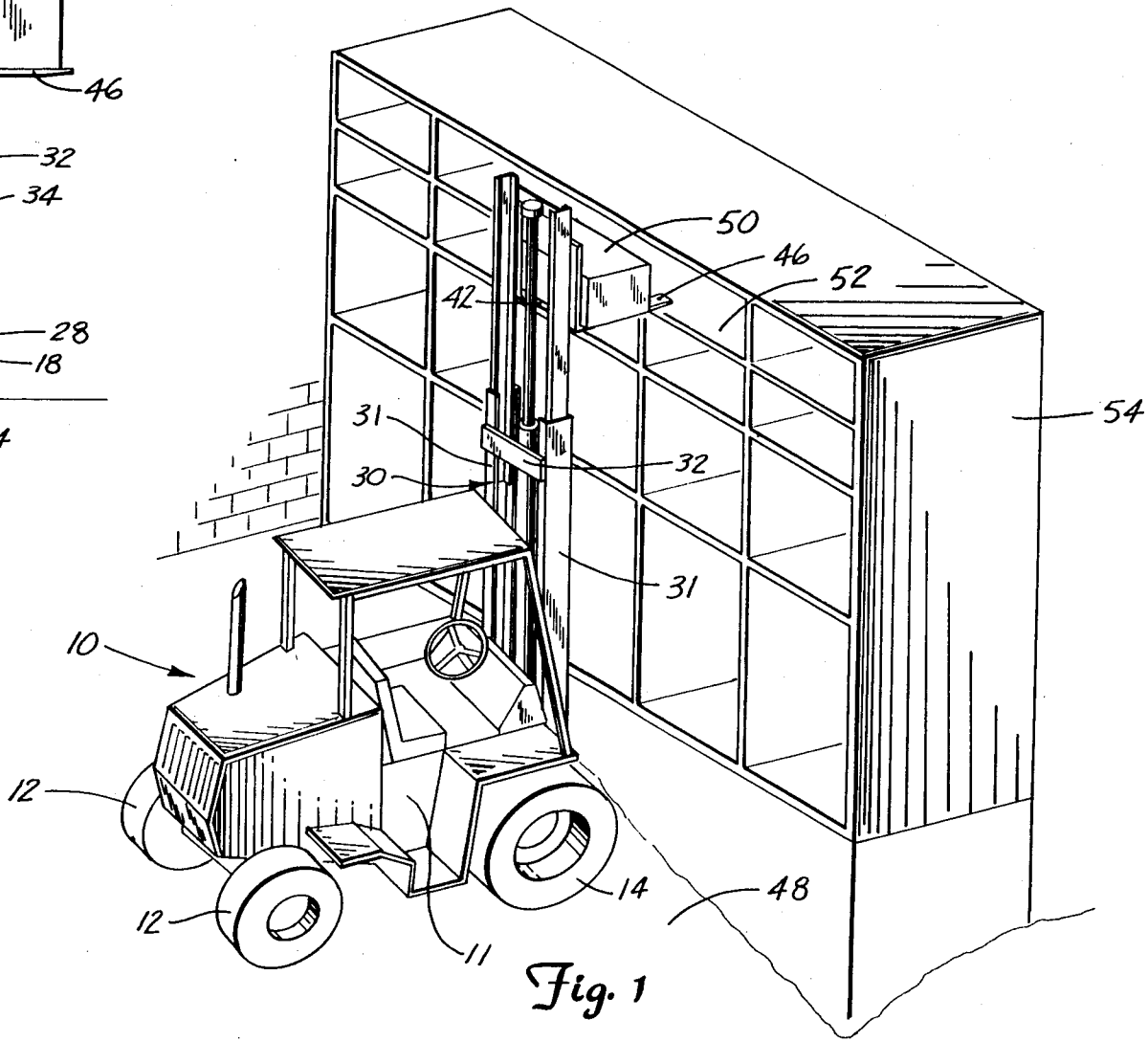
FIG. 1 is a perspective view of the apparatus of the invention shown in its relationship to a fork lift truck supported on ground which is not horizontal, the apparatus shown supporting a rectangular pay load in position to be deposited onto a horizontal surface.

A fork lift truck 10 includes a main frame 11 which is mounted on steerable wheels 12,12 and a pair of primary load support wheels 14,14. The load support wheels are rotatably supported to rotate on a common support wheel axis, indicated at 16. Wheels 14,14 are usually the powered drive wheels, but are not necessarily drive wheels.

For clarity, consistency, and ease of explanation, the end of the fork lift truck 10 adjacent the primary load support wheels 14,14 is considered the forward or front end, and the end of the truck supported by the steerable wheels is considered the rear end.

The apparatus of the invention includes an elongate mast support bar 18 and bar support means 19 to support opposite ends of the mast support bar 18 with respect to the main frame 11 of the truck.

The main truck frame 11 includes a pair of integral side plates 20,20 extending forwardly of the support wheels rotation axis 16. The mast support bar 18 includes a pair of concentric cylindrical outer end portions 22,22, and a central arc-shape guide portion 23 of square cross section integral with and extending between the end portions 22,22. Other non-circular cross sectional shapes for bar guide portion 23 will be satisfactory.

In the form of the invention as shown, the means to support the outer end portions 22,22 with respect to the main frame 11 of the fork lift truck includes bearings 26,26 each supported with respect to one of the side plates 20,20 and each rotatably supporting one of the cylindrical end portions 22,22.

In other contemplated forms of the invention, support means 19,19 could include means for fixedly mounting the mast support bar to maintain the arc-shape guide portion permanently in a vertical plane which lies in parallel relation to the support wheels rotation axis 16.

An arc-shape mast support sleeve 28 is hollow and congruent in cross sectional shape with the central guide portion 23 of the mast support bar 18. It is mounted around that arc-shape guide portion to be in sliding contacting relation to all four surfaces of the guide portion. The configuration of the hollow support sleeve 28 and the arc-shape guide portion 23 of the mast support bar 18 is such that movement of the sleeve along the arc-shape bar portion can occur without any rotational displacement of the sleeve around the bar.

While the sleeve and bar are shown as sliding, one with respect to the other, with metal to metal contact, it is within the contemplation of the invention that anti-friction devices can be used just so longitudinal movement of the sleeve with respect to the bar does follow the arc-shape path of the central portion 23 of the bar.

Figure 3:
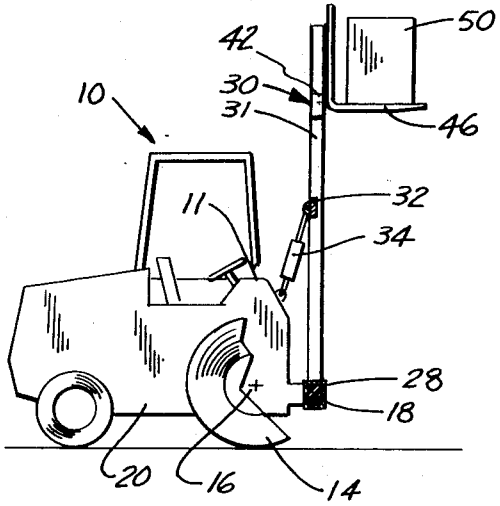
FIG. 3 is a vertical sectional view taken on the line 3—3 in FIG. 2.

A fork lift mast 30, including two upright parallel, spaced-apart mast legs 31,31 is permanently fixedly mounted to the support sleeve 28 and extends upwardly from that sleeve. The mast includes an intermediate cross bar 32 extending integrally between the mast legs 31,31. As best seen in FIG. 3, a first double-acting linear hydraulic motor 34 is pivotally connected to the cross bar 32 and to the fork lift truck 10. Linear motor 34 serves to hold the mast in its vertical alignment when the truck is traveling on level ground, and can be extended or contracted to maintain the mast in a vertical plane when the truck is positioned "uphill" or "downhill."

Linear motor 34 can be dispensed with and other means found to permanently position the mast with respect to the truck when the mast support bar is also permanently mounted with respect to the truck frame.

In order to cause the support sleeve 28 to slide with respect to the mast support bar 18, a second double acting linear hydraulic motor 36 is pivotably mounted as at 38 to a central bottom portion of sleeve 28 and is pivotably mounted as at 40 to a portion of the main frame 11 of the fork lift truck.

A carriage 42 is mounted to be moved up and down the mast 30 by means of any usual or preferred mechanisms, indicated generally at 44, but not specifically shown. Likewise, each of the mast legs 31,31 can be of a telescoping nature to be extendable in any usual or preferred manner well known in the art, but need not be.

As shown, the carriage 42 includes forwardly extending lift fork tines 46,46.

When the fork lift truck 10 is operating level horizontal ground, the second linear hydraulic motor will be positioned so that the mast support sleeve 28 is exactly in the center of the central arc-shape guide portion 23 of the mast support bar 18, thus to position the mast 30 in a vertical position. Before the present invention, this was the relative positioning of the mast with respect to the main frame 11 of the truck at all times irrespective of the angle of the truck supporting floor with respect to the horizontal.

Figure 2:
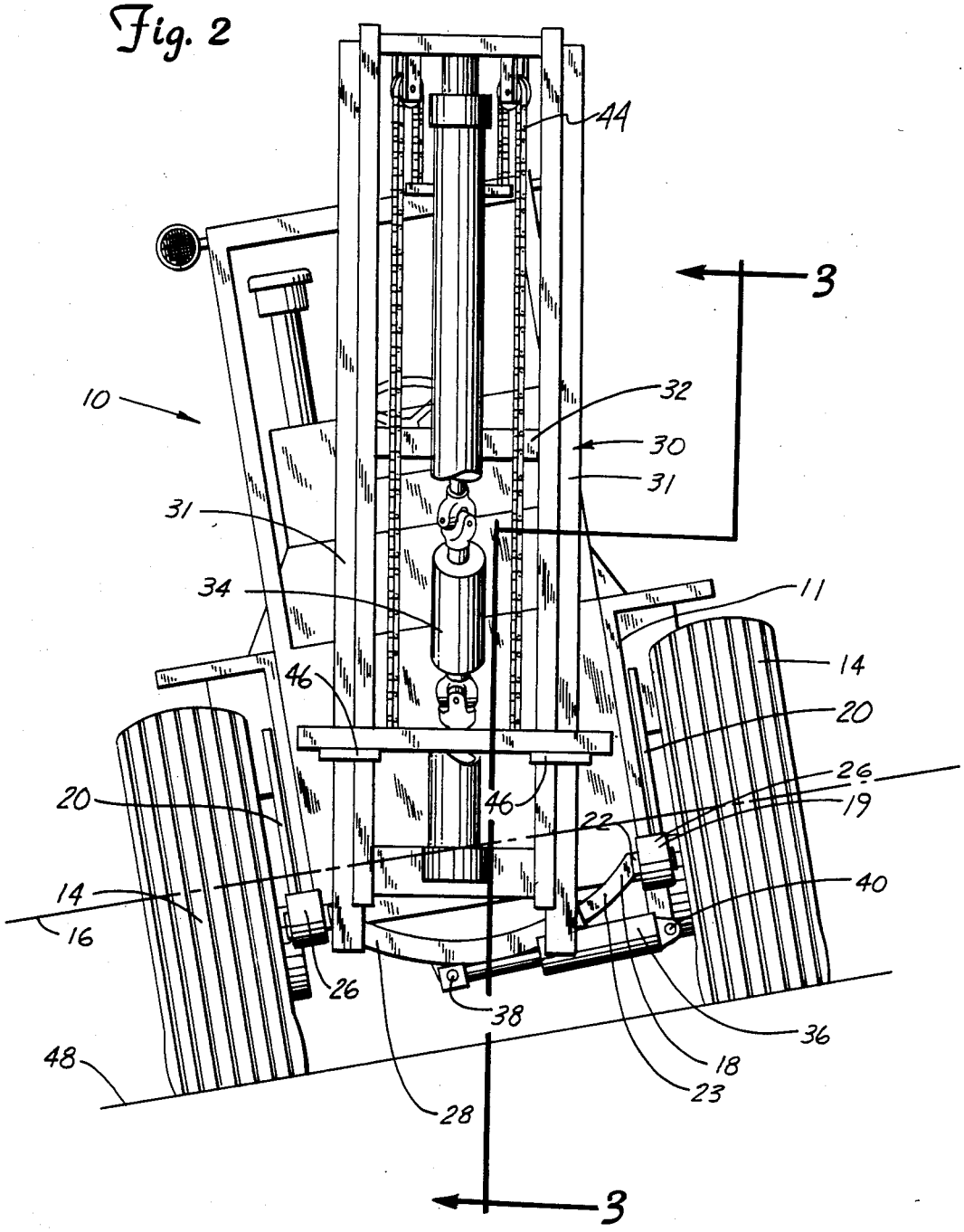
FIG. 2 is a front elevational view of a fork lift truck and the apparatus of the invention with the mast shown in a retracted position.
Figure 5:
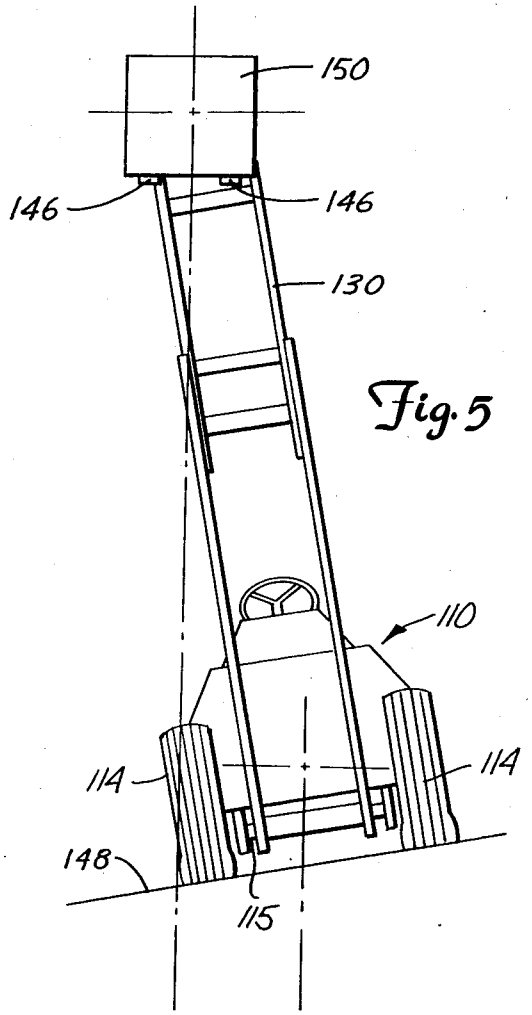
FIG. 5 illustrates a structure of the prior art handling a comparable load at a comparable height on a comparable non-horizontal "floor" as that shown in FIG. 4, and showing the relationship of the center of gravity of the pay load and the carriage with respect to the tipping point of a fork lift truck.
Figure 4:
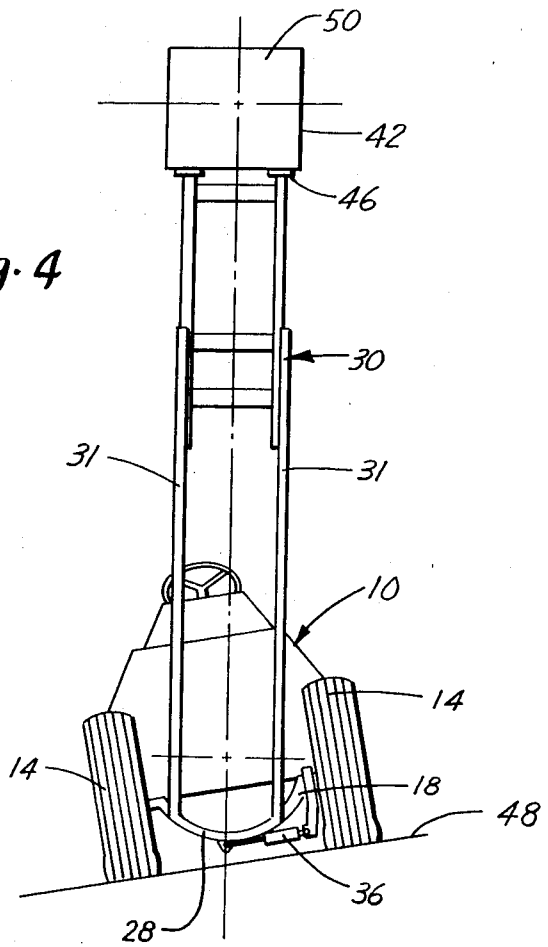
FIG. 4 is a front elevational view of the fork lift truck and apparatus of the invention substantially as seen in FIG. 1 and illustrating the relationship of the center of gravity of the pay load, carriage and mast with respect to the truck.

When an uneven "floor" such, for example, as the hard packed snowbank 48 in FIG. 1, is encountered, the second linear hydraulic motor 36 will be extended to position approximately as seen in FIG. 2, to cause the mast 30 to assume position as seen in FIG. 1. In this position, a pay load package 50 resting on tines 46,46 can easily be loaded onto a horizontal storage shelf 52 of an outdoor lumber yard storage rack 54, as shown; or, for example, construction materials 50 can be delivered over the rough terrain at a construction site to a horizontal floor of a building under construction. The apparatus of the invention has, at this point, been effective in two major respects. First, as clearly seen in FIG. 4, the center of gravity of the pay load package 50, the mast 30, and the carriage 42 has been moved only very slightly from the center of gravity of the truck 10 itself and has been kept well within the outside edges of the primary load support wheels 14,14; and secondly, the lift fork tines 46,46, and consequently the pay load package 50, are positioned, at the time when the pay load package is to be unloaded, in a horizontal position which makes it possible to load onto horizontal surfaces or to load into stacks of materials that are horizontally oriented.

Although the present invention has been described with reference to preferred embodiments, workers skilled in the art will recognize that changes may be made in form and detail without departing from the spirit and scope of the invention.

What is claimed is:

1. A self-leveling fork lift apparatus for use with a lift truck which includes a wheel supported main frame, a pair of primary load support wheels supported on a first front end portion of the main frame to rotate on a common axis, a pair of integral, parallel, spaced-apart extensions of the main frame extending forwardly of the load support wheels, and means to steer and propel the truck, said apparatus including:

A. an elongate mast support bar having a central arc-shape guide portion and two concentric outer end portions, each extending integrally outwardly from the central arc-shape portion;

B. bar support means to support the concentric outer end portions of the mast support bar on the spaced-apart main frame extensions to position the arc-shape guide portion of the mast support bar to extend downwardly and to lie in a substantially vertical first plane parallel to the support wheels axis;

C. an arc-shape mast support sleeve supported in surrounding relation to a part of the central portion of the mast support bar to be movable along the arc-shape guide portion of that bar;

D. a fork lift mast supported on the support sleeve and extending upwardly therefrom;

E. mast positioning means to position the mast in an upright position with respect to the main frame;

F. a power operated fork lift carriage supported on the mast for longitudinal movement up and down the mast;

G. said mast support sleeve being movable between a first position whereby the mast is tilted toward a first side of a second plane perpendicular to the support wheels rotation axis and lying midway between said support wheels, and a second position whereby the mast is tilted toward a second side of the second plane; and H. means to move said mast support sleeve along said mast support bar between said first and second positions.

2. The fork lift apparatus of claim 1 wherein:

I. sleeve positioning said sleeve positioning means includes first linear motor means pivotally mounted with respect to the main frame and pivotally mounted with respect to the sleeve.

3. The fork lift apparatus of claim 2 wherein:

K. the first linear motor means includes a double acting hydraulic motor pivotally mounted to the main frame at one end and pivotally mounted to the mast support slide at the other.

4. The fork lift apparatus of claim 1 wherein:

J. the bar support means includes a pair of bearings, each mounted to the main frame at opposite sides thereof.

5. The fork lift apparatus of claim 4 wherein:

K. the outer end portions of the mast support bar are cylindrical; and

L. each mast support bar bearing receives one of said cylindrical outer end portions of the mast support bar and supports it for pivotal movement about the common axis of these concentric mast support bar outer end portions.

6. The fork lift apparatus of claim 5 wherein:

M. the mast positioning means includes second linear motor means operably mounted between the lift truck main frame and the mast in spaced relation to the mast support sleeve.

7. The fork lift apparatus of claim 6 wherein:

N. the mast positioning first linear motor means includes at least one double acting hydraulic motor.

8. The fork lift apparatus of claim 1 wherein:

I. the arc-shape guide portion of the mast support bar is square in cross section; and J. the mast support sleeve is hollow, is concentric and congruent with the guide portion of the bar and in contacting, sliding relationship to all four surfaces of said guide portion.

9. The fork lift apparatus of claim 1 wherein:

I. the arc-shape guide portion of the mast support bar is non-circular in cross section; and J. the mast support sleeve is hollow, is concentric and congruent with the guide portion of the bar and in contacting, sliding relationship to all of the surfaces of the guide portion of the mast which define its non-circular cross sectional shape.

* * * * *